United States Patent [19]

Risch

[11] Patent Number: 4,519,739

[45] Date of Patent: May 28, 1985

[54] BACKHOE CLAMPING DEVICE

[76] Inventor: Joel V. Risch, 3275 Lucia Ave., Eureka, Calif. 95501

[21] Appl. No.: 614,183

[22] Filed: May 25, 1984

[51] Int. Cl.[3] ..... B66F 9/18; E07F 3/32

[52] U.S. Cl. ..... 414/724; 414/704; 414/739; 37/DIG. 12; 29/148.3; 29/428

[58] Field of Search ..... 37/117.5, DIG. 3, DIG. 12, 37/2 R; 414/912, 724, 722, 739, 704; 29/148.3, 428

[56] References Cited

U.S. PATENT DOCUMENTS

| | | | |
|---|---|---|---|
| 2,262,415 | 11/1941 | Williams et al. | 414/912 X |
| 3,061,123 | 10/1962 | Rogers | 37/DIG. 3 |
| 3,273,729 | 9/1966 | Holopainen | 414/739 X |
| 4,248,471 | 2/1981 | LaBounty | 414/739 X |
| 4,283,866 | 8/1981 | Ogawa | 37/117.5 |
| 4,375,345 | 3/1983 | Hanson | 37/117.5 X |

FOREIGN PATENT DOCUMENTS

| | | | |
|---|---|---|---|
| 1514412 | 1/1968 | France | 414/722 |
| 2071053 | 9/1981 | United Kingdom | 414/739 |
| 2083110 | 3/1982 | United Kingdom | 37/DIG. 3 |
| 293941 | 3/1971 | U.S.S.R. | 37/117.5 |
| 703629 | 12/1979 | U.S.S.R. | 37/117.5 |
| 753998 | 8/1980 | U.S.S.R. | 37/DIG. 12 |

*Primary Examiner*—Clifford D. Crowder

*Attorney, Agent, or Firm*—Townsend and Townsend

[57] ABSTRACT

A backhoe clamping device is provided which is designed to be easily added onto standard existing backhoe equipment. The device includes mounting brackets which are secured to the side bucket links of the existing backhoe and bucket arrangement. Clamp links are pivotally attached to these mounting brackets, thereby offsetting their pivot points from the existing links. Clamp arms are pivotally attached to the clamp links, as well as to the backhoe dipper arm. In this way, the existing backhoe leverage actuates the clamp arms, causing them to move in conjunction with the bucket to achieve a clamping effect.

11 Claims, 9 Drawing Figures

BACKHOE CLAMPING DEVICE

FIELD OF THE INVENTION

This invention relates generally to excavating and construction equipment, and more specifically to attachments for backhoe equipment.

BACKGROUND OF THE INVENTION

In the construction and excavation industry, many kinds of equipment have been developed to assist the workers in their numerous tasks. One piece of equipment that has achieved nearly universal acceptance in the industry is the wheel or track-mounted tractor equipped with a hydraulic backhoe and bucket. These machines can perform a variety of jobs, including lifting, trenching, clearing and excavation.

Some construction jobs, however, require a backhoe tool that can grip or clamp material from both sides, rather than just move or "scoop" the material from one side. For example, the picking up and placement of logs or pipe is best accomplished with a tool that provides a clamping effort.

Several types of backhoe attachments have been designed to achieve this clamping effect. Typically, the standard backhoe bucket is replaced with a completely self-contained clamping system including a pair or "jaws" each actuated by its own hydraulic cylinder. Alternatively, a second hydraulically actuated jaw can be added on to an existing single bucket system. Such systems do indeed achieve the required clamping effect, but they are very costly in that they require a second hydraulic unit, and often render the original backhoe equipment unsuitable for standard trenching type operations. In addition, these attachments are often heavy and difficult to use, as well as highly vulnerable to damage.

Some backhoe attachment units have been developed which utilize a "stiff arm" portion which provides a fixed second jaw against which the movable backhoe bucket can clamp an object. However, these systems generally are limited in their range of motion, and hence have reduced application.

SUMMARY OF THE INVENTION

A backhoe clamping device is provided which is designed to be easily added onto standard existing backhoe equipment. The clamping device mounts directly to the linkage and pivot points of a standard backhoe dipper and bucket, and converts the bucket to a clamping system by using the existing backhoe leverage to actuate a clamping jaw. The clamping device requires few parts, resulting in a product that is easy to manufacture, compact to ship and low in cost. One size of the clamping device fits most standard size backhoe buckets, and the design is easily fabricated to other sizes. In addition, the clamping device is easily and quickly installed on backhoe equipment, and adds little weight to the equipment, thereby not sacrificing lifting capacity. Furthermore, its few moving parts require little maintenance, and are easily removed and/or replaced.

The particular method of attaching the clamping device to existing equipment does not require any drilling of existing parts, which would tend to weaken the structural integrity of the original backhoe. Rather, mounting of the clamping device requires only a simple welding operation, and the replacement of a single original part (the bucket/dipper arm pin) of the standard backhoe. Removal of the clamping device is also easily accomplished, and does not adversely affect the original equipment.

A further benefit of this method of attachment is that the pivot points of the clamping device linkages can be placed to maximize the mechanical advantage of the clamping system. If these pivot points had to be placed at points on the existing backhoe structure, e.g. by drilling a hole in the existing linkages, the selection of pivot point positions to achieve this mechanical advantage would be severely reduced.

The clamping device includes a pair of limiting mechanisms which operate to control the maximum and minimum openings of the jaws. The maximum opening limiting mechanism results from the natural geometry of the pivot points of the clamping device and is important in that it prevents overextension and possible lock-out of the linkages. The minimum opening limiting mechanism is in the form of an adjustable stop and enables the clamping device to be adjusted to pick up fragile objects of a particular size, without the danger of further closing and crushing of the object between the jaws.

The clamping device also incorporates more than one set of positioning holes for its linkages, thereby offering a variety of closure alignments, which adds to its versatility.

The clamping device further includes a storage mechanism whereby the clamp can be easily and quickly disengaged from operation, and stored in a position where it does not interfere with standard bucket trenching operations. Furthermore, when the clamping device is in this stored position, the clamp is designed so as not to interfere with the arm extension of extendable dipper models of backhoe equipment.

A standard backhoe and bucket can thus be easily converted to a clamping-type tool. Thus converted, the backhoe can perform a number of tasks that a backhoe bucket alone could do only with considerable difficulty. For example, the backhoe clamping device enables the backhoe to perform tree and stump removal, log stacking and loading, rock removal and positioning (including rocks larger than the bucket itself), post pulling or any other application requiring a clamping effort.

DETAILED DESCRIPTION OF A PREFERRED EMBODIMENT

Figure 1:
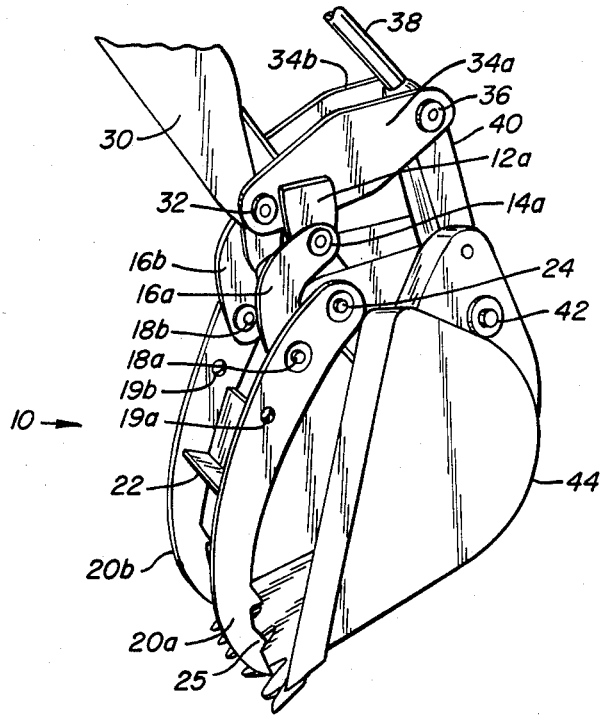
FIG. 1 is a perspective view of the backhoe clamping device of this invention as mounted on a typical backhoe dipper and bucket.

FIG. 1 is a perspective view illustrating a backhoe clamping device 10 as mounted to a standard backhoe dipper and bucket arrangement. The clamping device 10 includes right and left mounting brackets 12*a, b* (left mounting bracket 12*b* cannot be seen from this perspective), right and left link/bracket pins 14*a, b* (left link/-bracket pin 14*b* cannot be seen from this perspective), right and left clamp links 16*a, b*, right and left clamp-/link pins 18*a, b*, and right and left clamp arms 20*a, b*. The clamp arms 20*a, b* are secured to one another by a plate 22, and to the dipper and bucket arrangement by a clamp/dipper pin 24. Gripping protrusions or teeth 25 on the clamp arms improve the clamping ability.

The pertinent parts of the original backhoe dipper and bucket arrangement include a dipper arm 30, a lower side bucket link pin 32, right and left side bucket links 34*a, b*, an upper side bucket link pin 36, a hydraulic cylinder shaft 38, a bucket linkage 40, a bucket linkage/-bucket pin 42 and a bucket 44.

The backhoe clamping device 10 is designed to be easily and quickly added on to a standard, existing backhoe. The right and left mounting brackets 12*a, b* are first welded or otherwise secured to the outside surfaces of the right and left side bucket links 34*a, b*, respectively. The proper placement of these mounting brackets is critical, for it is from the offset pivot effect to the clamp links 16*a, b* that the backhoe clamping device gets its desired results. It is preferable to locate the brackets to maximize the resultant clamp leverage with the available amount of stroke. By placing the pivot point of the link/bracket pins 14*a, b* below and to the side of the center of the side bucket links 34*a, b*, the movement of the bucket links generates several times the clamping force at the clamp arms than would be generated by a pivot point placed in the center of the links 34*a, b*. In the preferred embodiment, the mounting brackets are placed so that the distance of the pins 14*a, b* to the pin 36 is greater than the distance of the pins 14*a, b* from the pin 32 by a ratio in the range of from 2:1 to 4:1. It has been discovered that such a placement yields the greatest practical clamping effect.

There are several other benefits to the placing of the pivot point off center with respect to the pins 32 and 36. First, by welding the mounting brackets to the side bucket links, the links themselves do not have to be drilled out to provide the pivot axis. Such drilling would require considerably more work than the mere welding of a bracket required by the invention. In addition, such drilling would weaken the structural integrity of the link itself. Furthermore, the offset placement of the brackets doesn't interfere with the normal operation of the links. On many kinds of equipment, a centrally located pivot point would interfere with the range of motion of the links, rendering the unit unusable in many applications. Thus, the mounting of the bracket in this manner offers the natural and required clearance necessary for uninhibited movement. Furthermore, in the preferred embodiment, the clamp links 16*a, b* are "kidney-shaped," and similarly avoid interference with the range of motion of the clamping device.

Once the brackets are mounted in place, the rest of the backhoe clamping device can be assembled. No parts or equipment from the original backhoe dipper and bucket are replaced, with the exception of the clamp/dipper pin 24, which must be replaced because it extends the full width of the dipper and must accommodate the added width of the clamp arms. By virtue of the fact that the original equipment is left essentially intact, subsequent removal of the backhoe clamping device is accomplished with a minimum of difficulty.

Figure 2A:
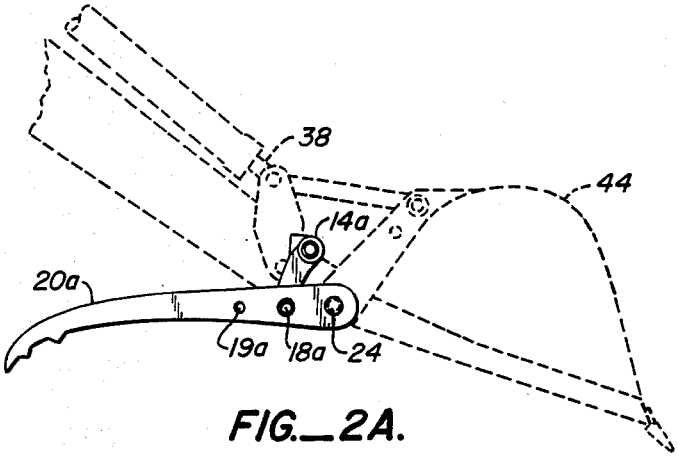
FIGS. 2*a* and 2*b* are elevated side views of the backhoe clamping device of this invention with the original equipment backhoe dipper and bucket drawn in phantom lines, FIG. 2*a* showing the clamp in its full open position, and FIG. 2*b* showing the clamp in its full closed position.
Figure 2B:
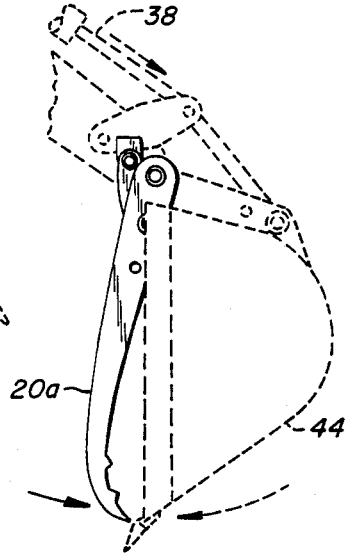

FIGS. 2*a* and *b* show the backhoe clamping device of this invention in operation, illustrating the relation of the various components and their range of motion. FIG. 2*a* shows the device in its fully open position. The hydraulic cylinder shaft 38 is retracted, thereby extending the bucket 44 and clamp arm 20*a* apart. FIG. 2*b* shows the shaft 38 extended, thereby bringing the bucket and clamp arm together.

FIG. 2*a* also illustrates the inherent maximum jaw opening limiting mechanism of the system. This mechanism results from the natural geometry of the pivot points associated with the pins 14*a*, 18*a* and 24. Because of this geometry, the clamp arm 20*a* is prevented from overextending to (and potentially beyond) full opening, where it would be in danger of "locking out" and being unable to return to closure.

Figure 3:
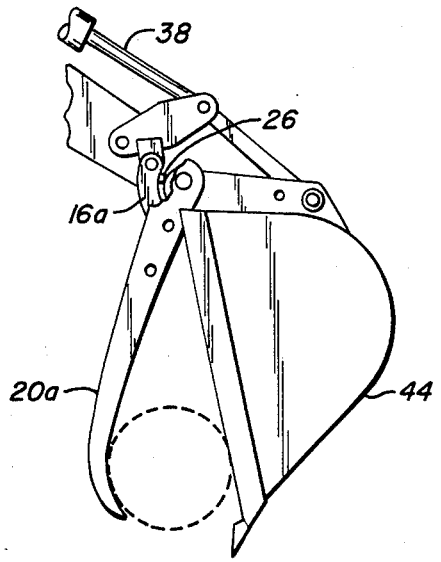
FIG. 3 is an elevated side view of the backhoe clamping device of this invention illustrating the minimum opening limiting mechanism.

FIG. 3 illustrates the minimum opening limiting mechanism of the system. This mechanism consists of a stop member 26 as placed on the clamp link 16*a* and/or 16*b*, where it acts to contact the bucket near the clamp-/dipper pin 24 and obstruct the further movement of the clamp link in that direction. This mechanism is preferably movable and/or adjustable to permit a wide range of minimum openings. This feature is particularly useful in adjusting the clamp opening to accommodate the size of a fragile item to be moved, without the danger of crushing the item if further clamping effort were exerted. Particular applications of this feature include the picking up and placement of plastic pipe, fragile containers, or the like, where repeated lifting operations must be performed on objects of the same size.

With the linkages installed as illustrated in FIGS. 1 and 2, the alignment of the meeting of the bucket 44 and clamp are 20*a, b* at closure is essentially straight down, as illustrated in FIG. 2*b*. This linkage arrangement also achieves the maximum travel of the jaws, i.e., the range between full open (FIG. 2*a*) and full closed (FIG. 2*b*). However, it is often desirable to adjust this alignment at closure, so that the bucket does not contact the clamp arm until the bucket has completed more of an arc. For example, if the tool is to be used for "peeling up" a sidewalk, the bucket must be able to reach around and under the piece of sidewalk before clamping takes place.

Figure 4A:
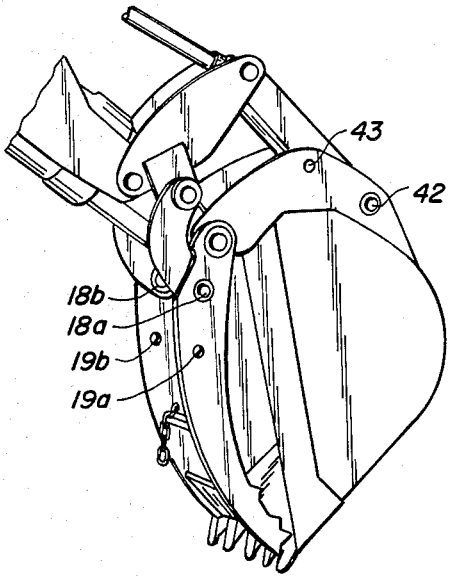
FIGS. 4*a*–4*d* are elevated side views of the backhoe clamping device of this invention showing the various closure alignments of the bucket and clamp.
Figure 4B:
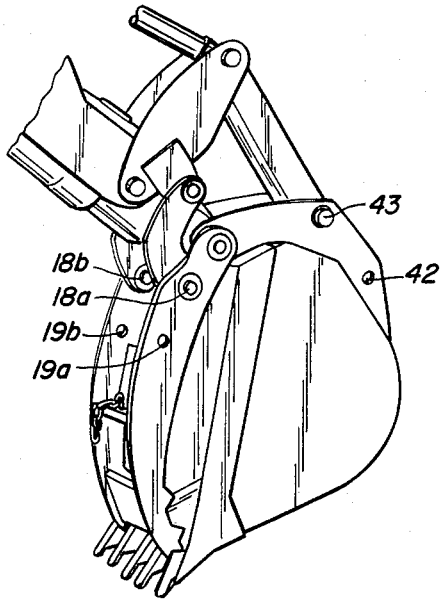
Figure 4C:
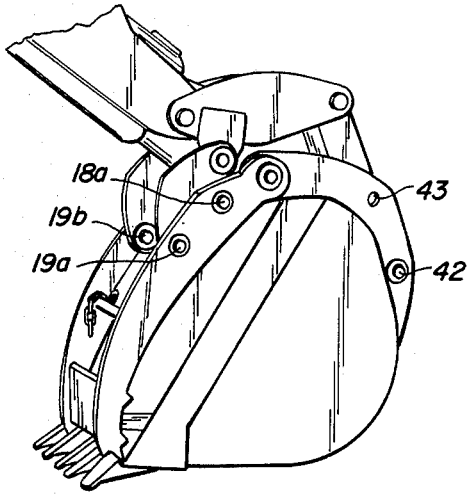
Figure 4D:
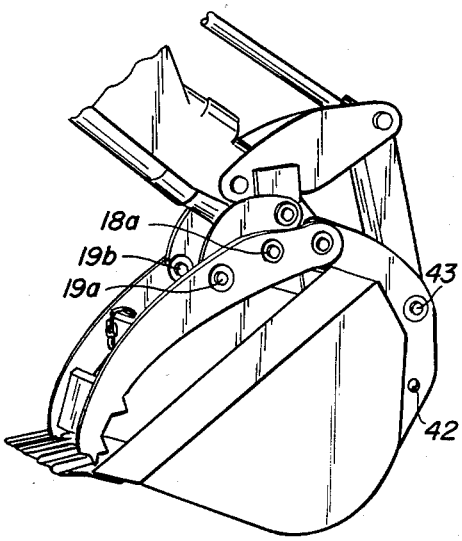

FIGS. 4*a* through 4*d* illustrate the alternative closure alignments that can be achieved by proper selection of the hole position for the clamp link pins 18*a, b* and/or bucket linkage/bucket pin 42. FIG. 4*a* shows the clamp link pins 18*a, b* and the bucket linkage/bucket pin 42 in their original hole positions, as in FIG. 2*b*. This results in a closure alignment that is essentially vertical, as indicated. Also shown are a set of alternate clamp link pin holes 19*a, b* and an alternate bucket linkage/bucket hole 43. FIG. 4*b* shows the pin 18*a* in its original position, but the pin 42 is now positioned in its alternate hole 43, resulting in a closure alignment slightly towards the backhoe, to the left of vertical. FIG. 4*c* shows the result with the pins 18*a, b* positioned in their alternate holes 19*a, b*, and the pin 42 in its original hole. This arrangement achieves an alignment slightly further towards the backhoe. FIG. 4*d* shows both the pins 18*a, b* and the pin 42 in their alternate positions, resulting in a closure alignment significantly moved towards the backhoe. Of course, an even greater variety of closure alignments could be achieved by inclusion of yet additional holes in the clamp arm.

Figure 5:
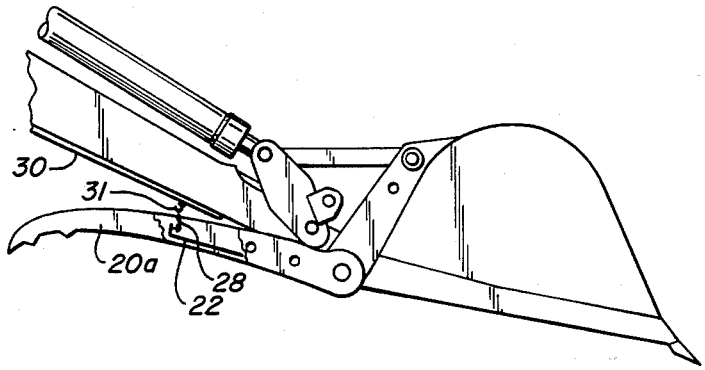
FIG. 5 is an elevated side view of the backhoe clamping device of this invention in its stored position.

FIG. 5 illustrates the storage mechanism for the backhoe clamping device. To store the clamp, the link/- bracket pins 14*a, b*, clamp links 16*a, b* and clamp/link pins 18*a, b* are removed, enabling the clamp arms 20*a, b* to be raised back until the plate 22 contacts dipper arm 30. A chain 28, which is secured to the plate 22, is then attached to a grab hook 31, which is welded to the dipper arm 30. This method of attachment serves to support the clamp arm against the dipper arm, and keeps the clamping device from interfering with standard bucket operations. Furthermore, by appropriate positioning of the chain and grab hook, only the plate 22 contacts the dipper arm and prevents other parts of the clamping device from interfering with the extension or retraction of the dipper arm (on extendable dipper models of backhoe equipment).

While this invention has been described in connection with preferred embodiments thereof, it is obvious that modifications and changes therein may be made by those skilled in the art to which it pertains without departing from the spirit and scope of the invention. For example, the clamp arms could be equipped with various kinds of gripping "teeth" for particular applications, or no teeth at all, as in the case of lifting particularly fragile items. In addition, the clamp arms could be shaped to accommodate any specific item, and since the device is easily removed and replaced, the unit could be returned to its standard operating mode without difficulty. Accordingly, the scope of this invention is to be limited only by the appended claims.

What is claimed as invention is:

1. Apparatus for attachment to a backhoe for conversion thereof to a clamping device, said backhoe having a bucket, a dipper arm and a bucket link, connected by a first pivot point between said bucket and said bucket link, a second pivot point between said bucket link and said dipper arm, and a third pivot point between said bucket and said dipper arm, said apparatus comprising:

at least one mounting bracket on said bucket link;

a clamp link pivotally mounted at one end thereof to said at least one mounting bracket at a fourth pivot point closer to said second pivot point than to said first pivot point; and a clamp arm pivotally mounted to a second end of each said clamp link at a fifth pivot point, and pivotally mounted to said dipper arm at a sixth pivot point.

2. The apparatus of claim 1 in which said sixth pivot point is coaxial with said third pivot point.

3. The apparatus of claim 2 in which said coaxial connections at said sixth and third pivot points are comprised of a single pin common to each.

4. The apparatus of claim 1 further comprising a stop member positioned to limit the range of pivotal movement of said clamp arm.

5. The apparatus of claim 1 further comprising a plurality of holes at different locations along said clamp arm to permit the placement of said fifth pivot point at alternative locations.

6. The apparatus of claim 1 further comprising detachable means for securing said clamp arm against said dipper arm.

7. The apparatus of claim 1 in which said clamp link is kidney shaped.

8. The apparatus of claim 1 in which the ratio of the distance between said fourth and first pivot points to that between said fourth and second pivot points is from 2:1 to 4:1.

9. A method of converting a backhoe to a clamping device, said backhoe having a bucket, a dipper arm and a bucket link, connected by a first pivot point between said bucket and said bucket link, a second pivot point between said bucket link and said dipper arm, and a third pivot point between said bucket and said dipper arm, said method comprising:

(a) mounting at least one bracket in fixed manner to said bucket link;

(b) mounting one end of a clamp link to each said bracket in pivotal manner at a point of attachment closer to said second pivot point than to said first pivot point;

(c) mounting a second end of each said clamp link to a clamp arm in pivotal manner; and (d) mounting each said clamp arm to said dipper arm in pivotal manner.

10. The method of claim 9 in which the pivotal mounting of step (d) is coaxial with said third pivot point.

11. The method of claim 9 in which the ratio of the distance between the point of attachment of step (b) and said first pivot point to the point of attachment of step (b) and said second pivot point is from 2:1 to 4:1.

* * * * *